US006237488B1

(12) United States Patent
Wilson et al.

(10) Patent No.: US 6,237,488 B1
(45) Date of Patent: May 29, 2001

(54) SCREEN PRINTING MACHINES

(75) Inventors: Robert Neil Wilson, Black Rock; Otto Richard Eppinger, Braeside, both of (AU)

(73) Assignee: Reefdale Proprietary Limited, Braeside (AU)

( * ) Notice: Subject to any disclaimer, the term of this patent is extended or adjusted under 35 U.S.C. 154(b) by 0 days.

(21) Appl. No.: 09/359,115

(22) Filed: Jul. 23, 1999

(30) Foreign Application Priority Data

Aug. 6, 1998 (AU) ..... PP5086

(51) Int. Cl.[7] ..... B41F 15/18

(52) U.S. Cl. ..... 101/126

(58) Field of Search ..... 101/114, 115, 101/126, 474

(56) References Cited

U.S. PATENT DOCUMENTS

| | | | | |
|---|---|---|---|---|
| 3,977,322 | * | 8/1976 | Jaffa | 101/126 |
| 4,031,825 | | 6/1977 | Jaffa | 101/126 |
| 4,735,139 | | 4/1988 | Szarka | 101/126 |
| 4,819,559 | * | 4/1989 | Szarka | 101/126 |
| 5,575,206 | * | 11/1996 | Szyszko | 101/126 |
| 5,592,877 | | 1/1997 | Szyszko et al. | 101/129 |
| 5,607,243 | * | 3/1997 | Szarka | 101/126 |
| 5,832,822 | * | 11/1998 | Hamu | 101/126 |

* cited by examiner

*Primary Examiner*—Stephen R. Funk
(74) *Attorney, Agent, or Firm*—Connolly Bove Lodge & Hutz

(57) ABSTRACT

A quick release pallet for a screen printing machine in which the pallet has locating recesses at either ends which locate the pallet on the pallet arm of the screen printing machine by engaging locating lugs on the pallet arm. A toggle clip secures the pallet in position. The advantages are that the pallet has no attachments and can be very quickly positioned and released. Because there are no screw holes in the top surface of the pallet it has a larger print area.

4 Claims, 5 Drawing Sheets

SCREEN PRINTING MACHINES

FIELD OF THE INVENTION

This invention relates to improvements in screen printing machines particularly to the pallet and pallet arm constructions used in such machines.

BACKGROUND TO THE INVENTION

Garments such as tee shirts are decorated using multi printing head, screen printing machines. The number of heads correspond to the number of colors to be printed. U.S. Pat. No. 3,795,189 (Jaffa) and U.S. Pat. No. 5,031,527 (Eppinger) disclose examples of the type of machines used in printing garments. The garments are supported on a pallet, which in turn is supported, for registry with the printing head, on a pallet arm. The pallet is moved successively past the desired number of printing heads until the printing is complete. Different size garments require correspondingly different sized pallets. Usually pallets are of the same length but vary in width from a garment sleeve width to a large body width. This means that the pallets need to be removed from the pallet arms on a frequent basis.

The positioning of the pallet on its pallet arm needs to be precise and secure to ensure that registration with successive printing heads is maintained. Conventionally one means of removably securing pallets to pallet arms has been to use 2 or 3 counter sunk screws at each end of the pallet. This is quite adequate in terms of registration accuracy and retention of alignment but involves extensive labor time to fit a new set of pallets to a machine. A number of quick release mechanisms have been proposed. Some use a key and keyhole type arrangement where either the pallet or the pallet arm has a keyhole slot and the other has a complementary head that can be locked into the narrow part of the slot. Another quick release means relies on the use of a rail and complementary track arrangement with either the pallet or the pallet arm having a rail and the other having a channel track of complementary cross section to the rail and a securing means to lock the two relative to one another for registration relative to the length of the arm. In most of these devices several wing nuts or bolts need to be tightened to secure the aligned pallet to the pallet arm.

U.S. Pat. No. 4,031,825 (Jaffa) discloses a pallet which fits sleeve-like over the pallet arm and is held in place by springs in the side edges of the pallet arm. Even though the pallet appears to be simple it needs to be fabricated or machined extensively as does the pallet arm.

U.S. Pat. No. 5,592,877 in part discloses a pallet which can be installed and released quickly and utilizes a pneumatic release mechanism to free the pallet. The pallet comprises two plates screwed together with the lower plate having lugs and slots that cooperate with recesses and a pin in the pallet arm to locate the pallet. Although these quick release arrangements are an improvement they do have short comings in terms of convenience and operator simplicity. Also they all involve additional manufacturing steps in preparing the pallets.

BRIEF DESCRIPTION OF THE INVENTION

To this end the present invention provides, in a screen printing machine of the type having a pallet mounted on a pallet arm which is successively brought into registry with a series of printing heads the improvement comprising a) a pallet having a longitudinal axis and leading and trailing edge portions extending laterally at each end of the longitudinal axis;

b) a pallet arm to support said pallet along its longitudinal axis;

c) at least one edge recess in either the leading or trailing edge of said pallet and at least one location recess in or adjacent to the other of said leading or trailing edges;

d) at least one fixed locating stop on said pallet arm adapted to fit said at least one edge recess; and e) at least one locating means mounted on said pallet arm remote from said at least one fixed locating stop, said locating means being of complementary shape to said at least one location recess in or adjacent to said leading or trailing edge of said pallet.

The pallet of this invention is unique in that it is an integral pallet devoid of parts welded or otherwise fixed to it and having no fixing holes or recesses in its upper surface.

In contrast to prior art quick release systems, the pallet of this invention requires no additional device or protrusion to be welded, mounted or adhered to its surface. The only precision machining required is to machine recesses into the edge of one end of the pallet and into the opposite edge or the base of the pallet adjacent the opposite edge. The pallets can in other respects be of the same shape and materials as is conventional for screen printing pallets.

Although two location points are adequate it is preferred to use 3 points. Preferably one adjustable point is located at the free end of the pallet arm and two adjacent the leading edge of the pallet when it is secured to the pallet arm. The recesses in the edges may be into the edge or into the top surface of the pallet at the edge. If the locating recess is into the base of the pallet it is preferably into the bottom surface of the pallet adjacent the trailing edge and shaped to fit over a lug or bolt head protruding from the surface of the pallet arm adjacent its free end. In order to press the pallet securely into its register position the surfaces of the recesses and the corresponding contact surfaces of the locating stops on the pallet arm are angled in complementary fashion so that the pallet is pressed along its longitudinal axis and also pressed onto the pallet arm. The final securing force can be provided by a spring clip or toggle clamp acting on the edge of the pallet opposite the edge which abuts the fixed stops on the pallet arm.

To fit the pallet, it is simply placed onto the pallet arm so that the locating stops are aligned with the recesses and then the spring clip or toggle is locked into place. Only one fastening action is needed in contrast to the need to fasten several bolts in the prior art devices. Because there are no screw or bolt holes in the top surface of the pallet, a larger surface area of the pallet is available for printing than is the case for prior art pallets. Because there are no protrusions or rails mounted on the pallet as is the case with prior art quick release pallets, the pallets of this invention pack flat and are easier to store, transport and clean.

BRIEF DESCRIPTION OF THE DRAWINGS

A preferred embodiment of this invention will now be described with reference to the drawings in which.

DETAILED DESCRIPTION OF THE INVENTION

Figure 1:
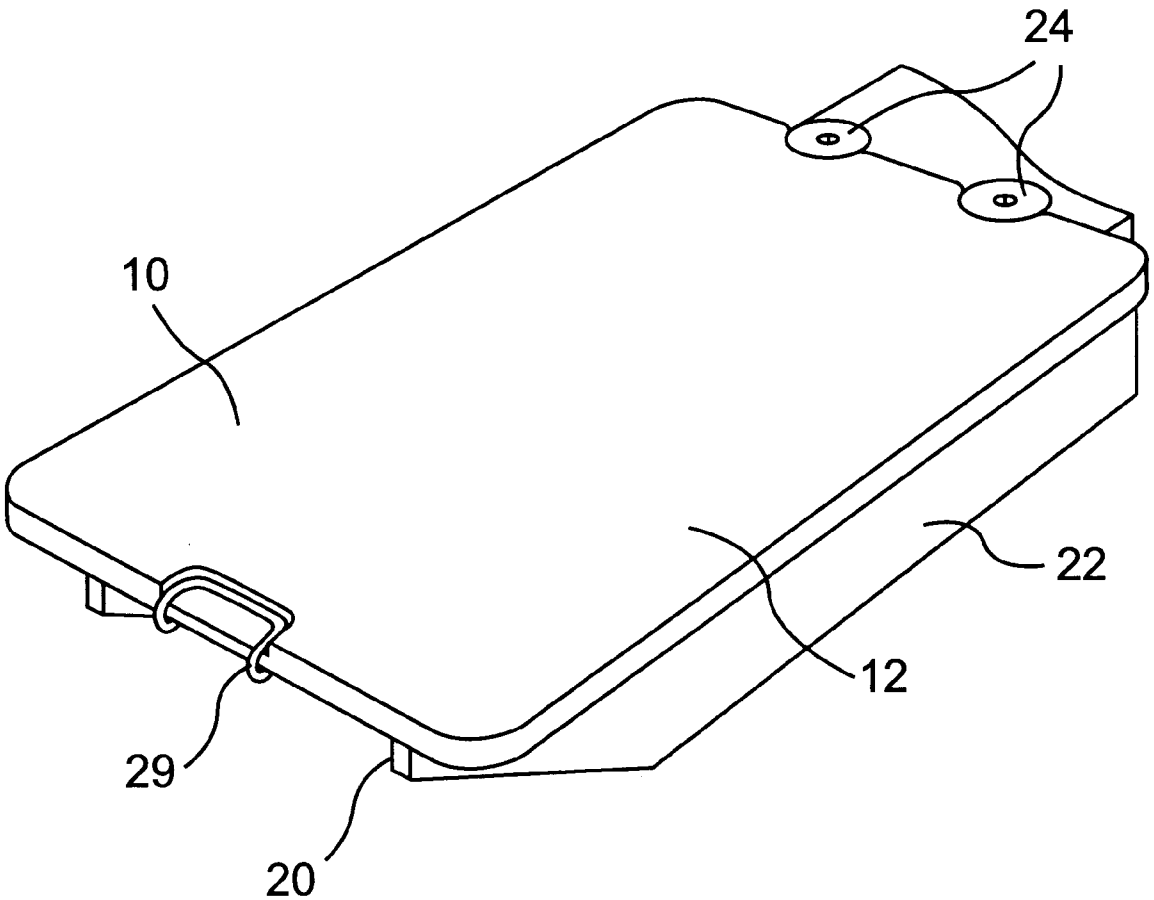
FIG. 1 is an isometric view of the assembled pallet arm and pallet of this invention.
Figure 2:
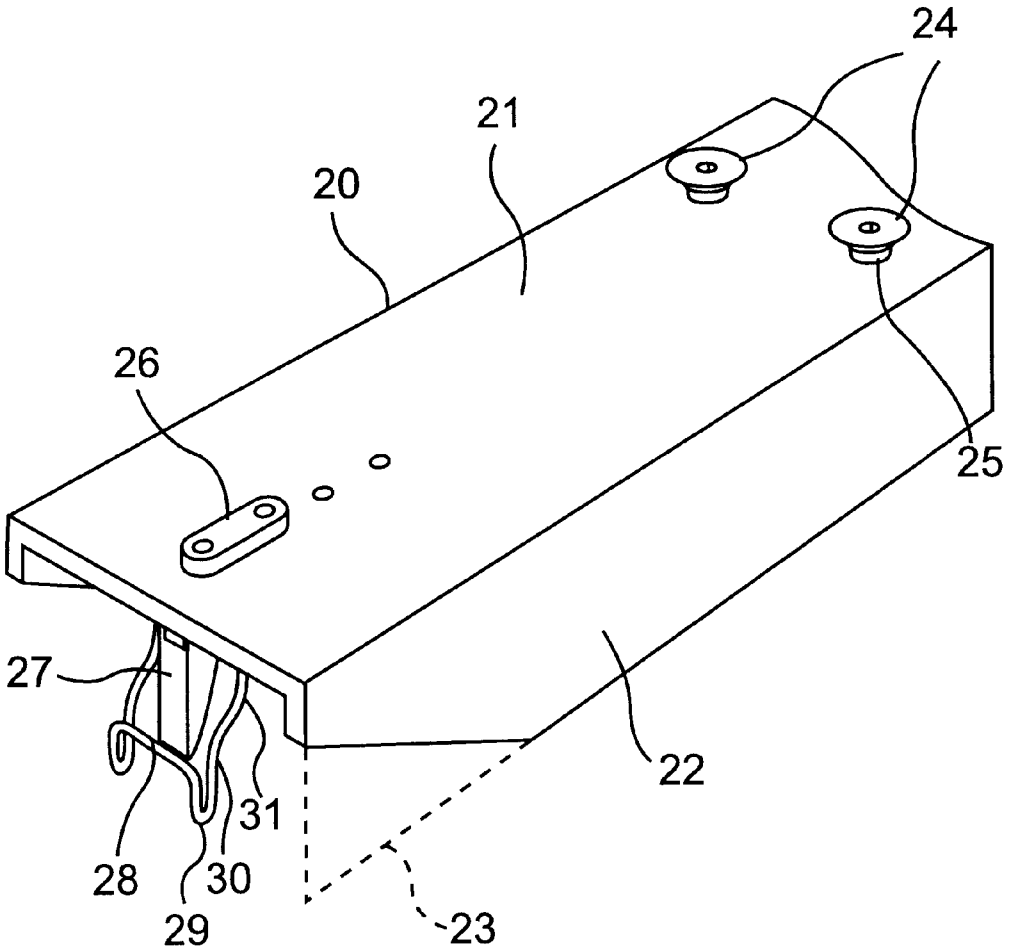
FIG. 2 is a view of the pallet arm.
Figure 3A:
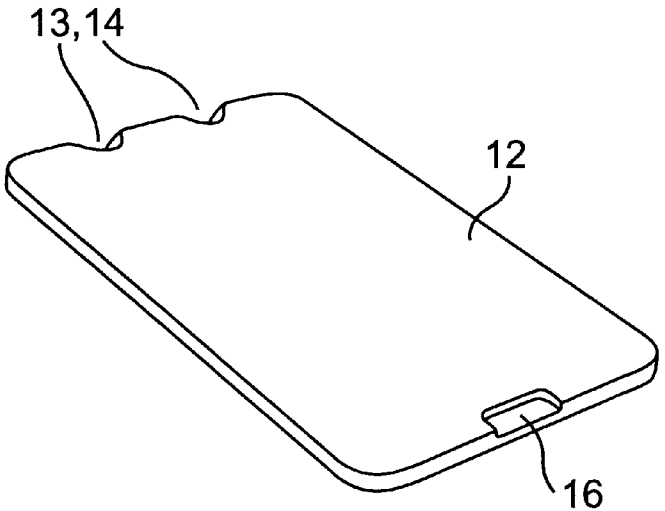
FIGS. 3A and 3B are views of the upper and lower surfaces of the pallet of this invention.
Figure 3B:
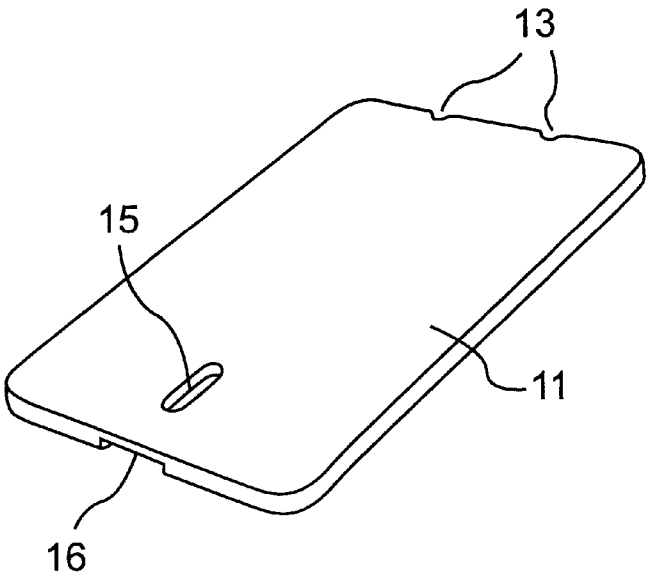

The pallet 10 is a flat aluminum cast plate of a size matched to the garment to be printed. The pallet has an upper surface 12 and a lower surface 11. The leading edge incorporates two recesses 13 of semicircular shape with chamfered or inclined faces 14. The trailing edge incorporates a clip recess 16. On the bottom surface adjacent the trailing edge is the location or key recess 15. The recess 15 is centered over the longitudinal center line of pallet 10 which passes through the mid point between the recesses 13.

The pallet arm 20 has an upper surface 21 and a side portion 22. Counter sunk bolt heads 24 protrude from the upper surface 21 of the pallet arm 20. The bolts 24 can be adjustable in height above the surface 21 and on the under sides of the screw heads 24 are inclined faces 25 which engage the surfaces 14 of the recesses 13 in pallet 10. Adjacent the free end of the pallet arm is the key protrusion 26 preferably of plastic and screwed into the surface 21 so that it can be removed. The protrusion 26 is slightly shorter in length than the corresponding locating recess 15 on the underside of pallet 10. The protrusion 26 is preferably centered on the longitudinal center line of the pallet arm which center line also passes through the midpoint between the stops 24.

Under the free end of the pallet arm 20 is the preferred locking mechanism a toggle clip comprising the over center toggle arm 27 and the clip 29. The end 28 of clip 29 seats in the recess 16 of pallet 10. The portion 30 of clip 29 engages underneath edge of the pallet arm surface 21 to exert spring pressure onto the edge recess 16 of pallet 10. The curved portion 31 of clip 29 applies a longitudinal force to the trailing edge of pallet 10 via the end 28 of the clip 29 engaging the recess 16. These two forces ensure that the pallet 10 is held securely in registry with the center line of arm 20.

The side 22 has a portion 23 cut away at the free end of arm 20 to improve access to the toggle 27 and clip 29. The clip end 28 is placed into engagement with the recess 16 of pallet 10 and the toggle 27 closed to lock the pallet into position. By making fine adjustments to the height of the screws 24 the longitudinal alignment of pallet 10 can be adjusted.

Instead of the toggle mechanism a spring loaded stop can be located on the free end of the pallet arm which engages a recess in the center of the pallets trailing edge. In such an arrangement the protrusion 26 and recess 15 may not be needed. The pallet in that construction would be pressed against the spring stop to locate the stops 24 in recesses 13 and then released so that the spring would press the pallet into position.

The recesses 13, 15 and 16 in the pallet are all subject to wear. The wear surface may be incorporated in a plate which fits within a recess in the pallet so that the surface of the pallet and the adjacent surfaces of the plate are flush. This enables the wear surfaces of the pallet to be replaced when wear affects their function. The plates containing the recesses 13, 15 and/or 16 may be secured to the plate by counter sunk screws or adhesives.

Figure 4:
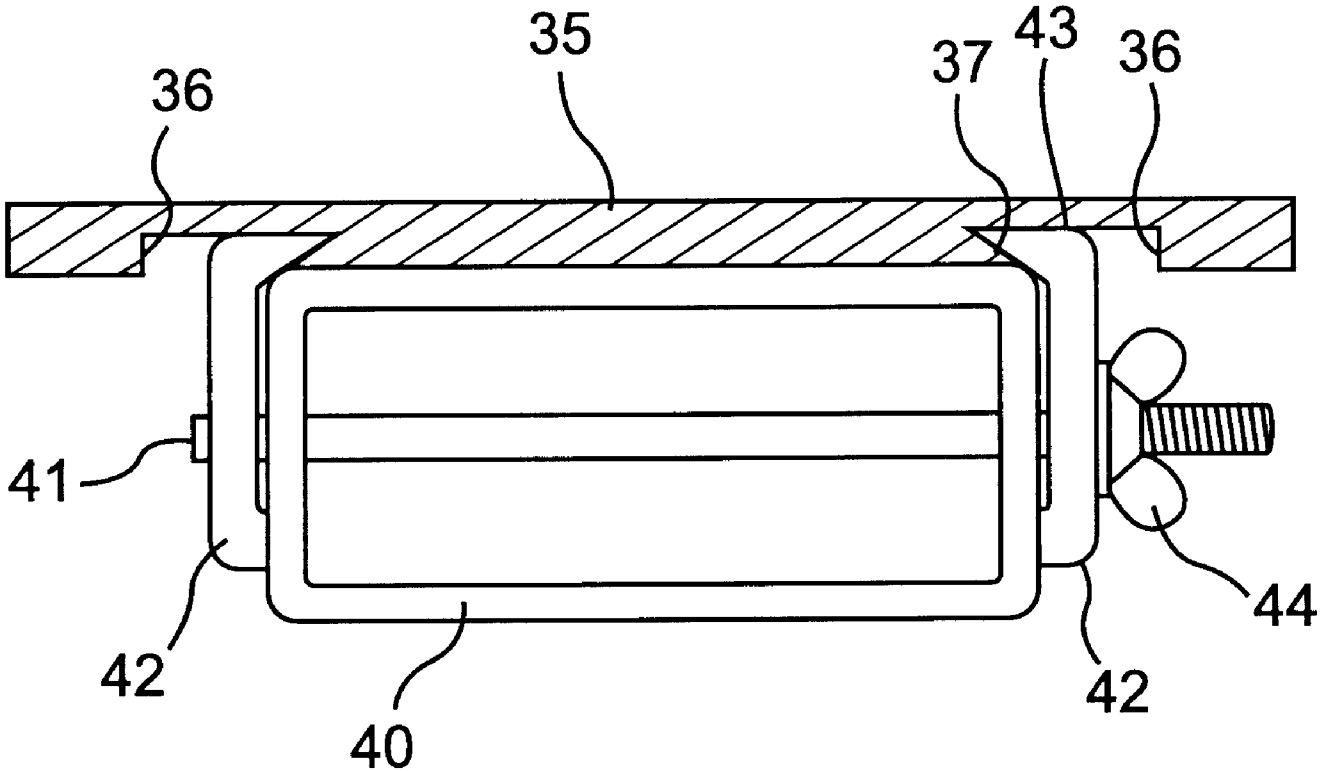
FIG. 4 is a sectional view of the pallet and pallet arm of a second embodiment of this invention.
Figure 5:
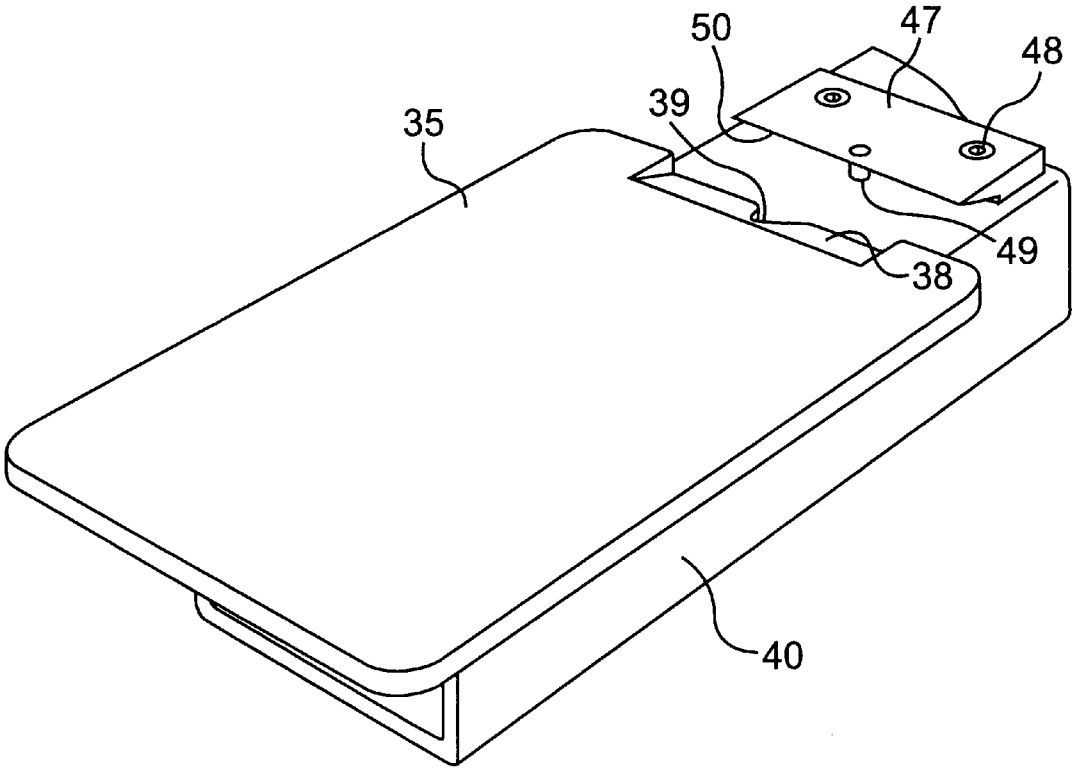
FIG. 5 is a partial exploded view of the leading edge of the pallet and its associated pallet arm of the same embodiment as shown in FIG. 4.

In the embodiment shown in FIGS. 4 and 5 an alternative fixing arrangement is shown. The pallet 35 is held to the pallet arm 40 at two positions. The leading edge of pallet 35 has a rectangular inclined recess 38 which incorporates a centering groove 39. The pallet arm 40 has stop 47 with an inclined facing edge 50 which engages the inclined recess 38 of pallet 35. The pin 49 on stop 47 engages the centering groove 39. The stop 47 is fixed to the pallet arm by the counter sunk screws 48.

The second securing position is shown in FIG. 4 where recesses 36 in the undersurface of pallet 35 are engaged by the grips 42. The recesses 36 incorporate in the inner edges wedged grooves 37 which are engaged by the wedged ribs 43 on the grips 42. The grips 42 are mounted on the pallet arm 40 by a screw threaded shaft 41. Rotation of the shaft 41 by turning handle 44 tightens or loosens the grips 42. This alternative need not have any clamp on the trailing edge of the pallet. The pallet 35 is placed over the pallet arm 40 so that the grips 42 enter the recesses 36, then the pallet is urged against stop 47 so that pin 39 fits in groove 39 and then the grips are tightened by turning handle 44 so that the ribs 43 are urged into the grooves 37.

From the above description it can be seen that this invention provides 1) a pallet that is simple to machine with no added devices or protrusions.
2) The pallet is simple to assemble to the pallet arm.
3) The pallet has a larger free surface for printing because there are no screw holes through its top surface
4) The pallet and arm can be made from off the shelf components which reduces the costs of production.

What is claimed is:

1. In a screen printing machine of the type having a pallet mounted on a pallet arm which is successively brought into registry with a series of printing heads the improvement of a pallet and pallet arm combination comprising a) a pallet having a longitudinal axis and leading and trailing edge portions extending laterally at each end of the longitudinal axis;
b) a pallet arm to support said pallet along its longitudinal axis;
c) at least one edge recess in either the leading or trailing edge of said pallet and at least one location recess in or adjacent to the other of said leading or trailing edges;
d) at least one fixed stop on said pallet arm adapted to fit said at least one edge recess; and
e) at least one locating means mounted on said pallet arm remote from said at least one fixed stop, said locating means being of complementary shape to said at least one location recess in or adjacent to said leading or trailing edge of said pallet.

2. A pallet and pallet arm combination as claimed in claim 1 which additionally incorporates a locking recess in the leading or trailing edge of said pallet remote from said edge recess and said pallet arm includes a clamp which cooperates with said locking recess to hold the pallet securely to said pallet arm.

3. A pallet and pallet arm combination as claimed in claim 2 wherein a) the at least one edge recess is in the leading edge of the pallet; and
b) the clamp is a toggle clamp mounted so that it extends from below the free end of the pallet arm, around the free end of the pallet arm and onto the trailing edge of the pallet to exert a hold down force on said pallet and a horizontal force to urge the pallet against said fixed stop.

4. An integral pallet for supporting an item to be screen printed having a) a top surface and a bottom surface;
b) a longitudinal axis and leading and trailing edge portions extending laterally at each end of the longitudinal axis;
c) at least one edge recess in either the leading or trailing edge portion of said pallet; and
d) at least one location recess in one of the pallet surfaces in or adjacent to the other of said leading or trailing edge portions.

* * * * *